United States Patent [19]

McCord

[11] 4,128,294

[45] Dec. 5, 1978

[54] CABLE CLAMPS

[75] Inventor: Daniel McCord, Geneva, Ill.

[73] Assignee: Ideal Industries, Inc., Sycamore, Ill.

[21] Appl. No.: 861,875

[22] Filed: Dec. 19, 1977

[51] Int. Cl.[2] ..... H01R 9/10

[52] U.S. Cl. ..... 339/266 R

[58] Field of Search ..... 339/266

[56] References Cited

U.S. PATENT DOCUMENTS

| | | | |
|---|---|---|---|
| 3,406,372 | 10/1968 | Lawlor | 339/266 R |
| 3,801,952 | 4/1974 | Lawlor | 339/266 R |
| 3,879,104 | 4/1975 | Shugarman et al. | 339/266 R |

*Primary Examiner*—Joseph H. McGlynn

*Attorney, Agent, or Firm*—Kinzer, Plyer, Dorn & McEachran

[57] ABSTRACT

Hinged jaw members having aligned bores for crimping a conductor and in which the jaws are held open by a rib-supported protuberance swaged from an end thereof on one member, the protuberance engaging the lip of a keeper notch presented by the other member.

3 Claims, 5 Drawing Figures

CABLE CLAMPS

This invention relates to a cable clamp of the form shown in U.S. Pat. No. 3,801,952 wherein two jaw members are held in an open position by a rib engageable with the lip of a so-called keeper notch. The engagement between the rib and the lip is a mere interference engagement such that with an applied force of adequate magnitude the rib can be forced past the lip in a jaw closing movement. In the closed position, the rib fits in the keeper notch.

In the open position, the two jaw members have their cable receiving bores aligned, which is deemed by the electrician to be of great help when inserting the cable.

The jaw members are extruded from a light weight, easily deformable conductive metal such as aluminum. The sequence of steps is to extrude two long stock bars having the respective cross section of the two jaws. The extrusions are sectioned (by a saw for example) and then all the holes are drilled. This is the known method and it is employed in manufacturing the cable clamp herein disclosed.

As already mentioned the metal is soft and easily worked. The extruded parts are long. As a consequence there may be a great deal of variation in dimension in the course of a production run. This variation increases as the dies wear. This lack of tight or close precision, with one exception, is tolerated because close tolerance fits are not required for the jaw members from the standpoint of assembly, installation or utility. Indeed, a loose fit presents some advantages.

The interference fit between the rib and the lip of the notch for holding the jaws open is an exception to loose tolerance allowances. The interference fit should be such that at least a three pound force is required to overcome it (manual force) but not more than one hundred pounds which may require a tool (hammer blow) to close the jaws. It will be recognized that this tolerance itself is a large one; nonetheless it is found that the minimum force requirement frequently is not met due to metal working and die performance, meaning the electrician may get a clamp not having the ability to hold the open position, except accidentally.

The primary object of the present invention is to assure the minimum holding force is always achieved and to accomplish this by a rib having swaged or upset ends manifest in a rib constituting a support for the upset protuberance, the protuberance being the element having an interference fit with the lip of the holding notch. As a consequence, wear of the extrusion die, in the area of the rib, or any other production imperfection for structuring the rib, becomes inconsequential because the protuberance may be formed with considerable accuracy as the final step in production by locating the jaw member in a fixture having opposed swaging pins for upsetting the ends of the rib, uniformly for each jaw member.

Figure 1:
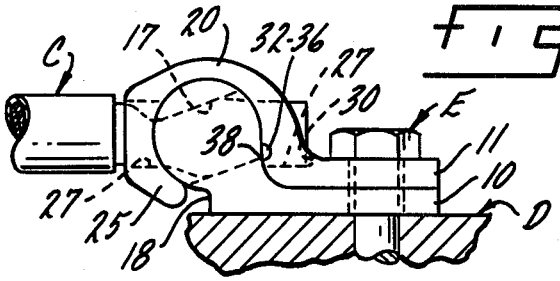
FIG. 1 is a side elevation of a cable clamp, constructed in accordance with the present invention, in closed position and showing a cable in clamped position.

Referring now to the drawing in detail which shows therein, as an example of one form in which the invention may be embodied, a solderless electric terminal comprising, in general, a male jaw A, and a female jaw clamp B adapted to receive and clamp an electrical conductor C (e.g. a cable) and to be secured to a support D by means of a screw or bolt E.

Jaws A and B have respective attachment tails 10 and 11 which have respective apertures 10A and 11B through which fastener E may be inserted and secured in or to the support D. Tails 10 and 11 are of flat plate form and are adapted to come together in flat face-to-face contact in the closed position of the cable clamp as indicated in FIG. 1.

Male jaw A consists of the tail 10, a cylindrical head 15 joined to a neck 16 rising integrally from tail 10, and a cylindrical bore 17 piercing the head 15 in the median vertical longitudinal plane of jaw A.

The back of neck 16 is generally normal to the plane of tail 10, and the front side of head 15 protrudes forwardly from neck 16, overhanging a transverse stop 18 in the male member. Bore 17 is inclined downwardly and forwardly with reference to the plane of tail 10 at an angle of between 15° and 30° (e.g., approximately 20°) which is substantially equal to the angle of opening between tails 10 and 11 in the open position shown in FIG. 2.

Figure 2:
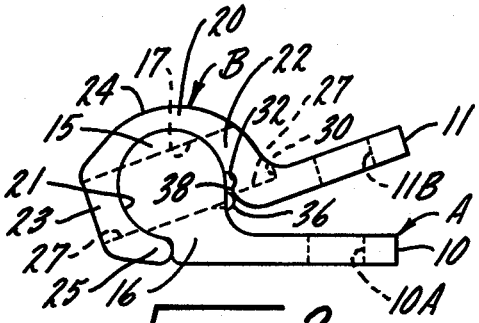
FIG. 2 is a side elevation of the cable clamp in open position.

Female jaw B consists of the tail 11 and an open socket yoke 20 of approximately 270° arcuate extent, having a transverse cylindrical socket 21, loosely fitted around male jaw head 15 and rotatable thereon between its open position shown in FIG. 2 and its closed position shown in FIG. 1.

Yoke 20 includes an arm 22 rising substantially vertically from tail 11, a forward arm 23 diametrically opposite arm 22, and a crown 24 bridging between arm 22 and opposed arm 23.

Arm 23 extends vertically downwardly from crown 24 and terminates in a free end having a finger 25 extending beneath the head 16 toward stop 18 which extends back just far enough to receive the finger 25 when jaw B is hinged to its open position.

A bore 27 extends through arms 22 and 23, substantially parallel to tail 11 and substantially through the center of socket 21, so as to be aligned with the bore 17 of head 15 when jaw B is in its open position. The lower area of bore 27 is recessed to lie below the upper surface of tail 11 to a point just beyond the arm 22, where a stop shoulder 30 defines the end of the bore in the female yoke, FIG. 5.

One of the jaw members is formed with a keeper notch and the other member is formed with a rib supporting at least one protuberance struck therefrom as by swaging the end of the rib. The protuberance normally holds the jaw members open due to an interference fit with the lip of the notch, but because the parts are of soft metal the protuberance will yield and in the closed position resides in the keeper notch.

Figure 5:
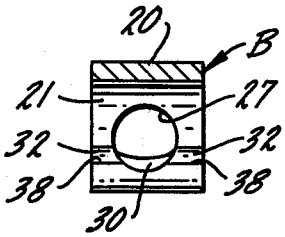
FIG. 5 is a sectional view, through the yoke, of the female member.

Specifically, the female jaw member has a keeper notch 32 formed therein, extending transverse to the bore 27, FIG. 5, generally in the plane of the stop 30. The male jaw member is formed with a rib 34 presenting at the opposed ends thereof a protuberance 36 of greater height or thickness than the rib 34. The rib extends transverse to the bore 17 and in fact spans the lower segment thereof, FIG. 3.

The parts are extruded in long bar stock from aluminum billets. The extruded stock has, except for the bores and fastener apertures, the cross section of the two jaw members including the keeper notch 32 and the unswaged rib 34.

Figure 3:
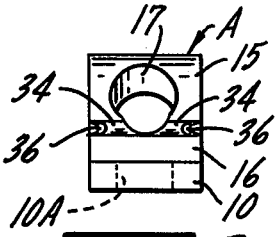
FIG. 3 is an end view of the male jaw member.
Figure 4:
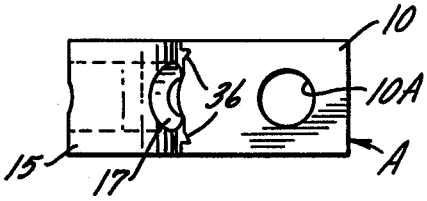
FIG. 4 is a top plan view of the male jaw member.

The jaw members are separated from the bar stock in the width shown in FIGS. 3 and 5 and then drilled. The remote outer ends of the unswaged rib 34 extend to and are coplanar with the lateral sides of the male member. The remote outer ends of the notch terminate at the lateral sides of the female member. The final step is to swag the ends of the rib to present the protuberances 36; the unswaged rib end portions afford the metal for the protuberances and the inner rib portions, on opposite sides of the bore 17, support the protuberances.

In the open position of jaw B a latch or lip projection 38 at the junction of arm 22 and tail 11, immediately below keeper notch 32 will rest on the upper sides of protuberances 36 so as to hold the jaw B in the open position, while the tip 25 of arm 23 will extend into the recess at the front of stop 18 substantially into engagement with neck 16 so as to limit opening movement of jaw B substantially at the position shown in FIG. 2. Thus the jaw B is held in an open position in which the respective ends of bore 27 will be aligned with bore 17 so that the bared end of conductor C can be inserted through the two bores to a limit position determined by engagement of its forward end against the shoulder 30. The jaw B may then be closed upon jaw A by application of downward pressure against tail 11 sufficient to overcome the slight interference engagement which exists between lip projection 38 and locking protuberances 36 in the open position of the jaw.

In forcing the lip 38 past protuberances 36 the latter yield to allow passage. As the projection 38 clears the protuberances, that is, is forced past the crest or crown of each protuberance, the lip is engaged beneath the protuberances in a hook or latch relationship firmly locking the jaws together in the closed position. In this position the closed terminal, with conductor C securely clamped between its jaws, can be attached to support D by inserting fastener E into body D.

The closing movement of jaw B will cause the bores 17, 27 to become misaligned angularly so as to crimp the bared end of conductor C with gripping engagement thereof at opposite ends of bore 17.

It will be noted that the latch lip 38, inherent to the keeper notch as a boundary thereof, opens upwardly so that its outer radius normally rests on the protuberances in the open jaw position. Consequently the lip 38 can easily be moved downward past the opposed surfaces of the protuberances with a mild camming action (only a few pounds of applied force) to which the protuberances yield or compress elastically, being of soft metal. The reverse movement, after latching, is firmly resisted, however, because in the closed jaw position the inner surface of the lip 38, opening upwardly, hooks under the protuberances so that a considerable force is required to re-open the jaws.

The protuberances, though small, are not crushed and are purposely sized to offer an interference projection easily overcome by the desired minimum force to close the jaws. While there is observable wear on the protuberances after repeated closing and opening in an abusive sense, this does not happen in practice since the jaws are usually closed only once, or twice as a rule. Indeed, the soft metal protuberances offer little resistance to the closing force, which is to say they offer less resistance than were the rib to take their place. On this, indeed, hangs another advantage because the protuberances can be swaged consistently to a close tolerance limit more nearly approximating the desired resistance for a minimum closing force.

I claim:

1. In a cable clamp including a male jaw member having a trunnion-like head formed with a cable-receiving bore, said clamp also including a female jaw member having a yoke presenting an internal socket shaped complemental to said head, and with a cable-receiving bore formed in the yoke, whereby the head and yoke may be interfitted for movement of the jaw members between an open position where the bores are aligned to enable the cable to pass therethrough and a closed position where the bores are misaligned to crimp the cable, the improvement comprising a raised rib on one of the members projecting toward the other member with an end portion of the rib swaged inward toward the bore of the related member to afford a protuberance thereon of greater height than the remainder of the rib, a notch in the other member opposed to said protuberance, the notch presenting a lip which rests on the protuberance to hold the members in open position, the protuberance yielding to movement of the lip therepast to allow the jaws to be closed by a closing force applied to the members.

2. A cable clamp according to claim 1 in which the jaw members are of a soft metal, in which the rib crosses the bore in the male member, and in which the outer end portions of the rib, on both sides of the bore, are swaged inward toward the bore to afford two protuberances.

3. A cable clamp according to claim 2 in which the lip and notch together define an upwardly opening hook having an outer radius reposing on the protuberances in the jaw open position.

* * * * *